US010961953B2

(12) United States Patent
Chini et al.

(10) Patent No.: US 10,961,953 B2
(45) Date of Patent: Mar. 30, 2021

(54) CONTINUOUSLY OPERATING WATER RECOVERY APPARATUS FOR A MOTOR VEHICLE

(71) Applicant: Röchling Automotive SE & Co. KG, Mannheim (DE)

(72) Inventors: Fabrizio Chini, Isera (IT); Gloria Paoli, Riva del Garda (IT)

(73) Assignee: Röchling Automotive SE & Co. KG, Mannheim (DE)

( * ) Notice: Subject to any disclaimer, the term of this patent is extended or adjusted under 35 U.S.C. 154(b) by 93 days.

(21) Appl. No.: 16/385,726

(22) Filed: Apr. 16, 2019

(65) Prior Publication Data

US 2019/0323455 A1 Oct. 24, 2019

(30) Foreign Application Priority Data

Apr. 18, 2018 (DE) ..... 10 2018 205 890.3

(51) Int. Cl.
*F02M 25/022* (2006.01)
*F02M 25/03* (2006.01)
*F02D 19/12* (2006.01)

(52) U.S. Cl.
CPC ..... *F02M 25/0222* (2013.01); *F02D 19/12* (2013.01); *F02M 25/03* (2013.01)

(58) Field of Classification Search
CPC ..... F02M 25/0222; F02M 25/0224; F02M 25/025; F02M 25/03; F02D 19/12; F02D 41/0025
USPC ..... 123/25 C
See application file for complete search history.

(56) References Cited

U.S. PATENT DOCUMENTS 7,251,945 B2 8/2007 Tongue
2007/0028769 A1 2/2007 Eplee et al.
2018/0320638 A1* 11/2018 Kouzel ..... F02B 29/0468

FOREIGN PATENT DOCUMENTS

DE 102016206043 A1 * 10/2017 ..... F02M 25/025
DE 102016206043 A1 10/2017

OTHER PUBLICATIONS

German Search Report for corresponding DE 10 2018 205 890.3 dated Feb. 12, 2019, 9 pgs.
Espacenet Bibliographic data:DE 102016206043 (A1), Published Oct. 12, 2017, 1 pg.

* cited by examiner

*Primary Examiner* — Lindsay M Low
*Assistant Examiner* — Omar Morales
(74) *Attorney, Agent, or Firm* — Rankin Hill & Clark LLP; Gregory S. Vickers

(57) ABSTRACT

A water recovery apparatus for a motor vehicle, for recovering water from ambient air, encompasses:
- a conveying conduit;
- a condenser device that is embodied to modify the absolute value of at least one dew-relevant state variable of a working gas delivered through the conveying conduit to the condenser device;
- a water discharge device that is embodied to discharge from the condenser device water condensed out of the working gas by the condenser device, the conveying conduit being embodied to convey ambient air as the working gas to the condenser device, the water recovery apparatus is embodied to deliver working gas continuously to the condenser device.

15 Claims, 1 Drawing Sheet

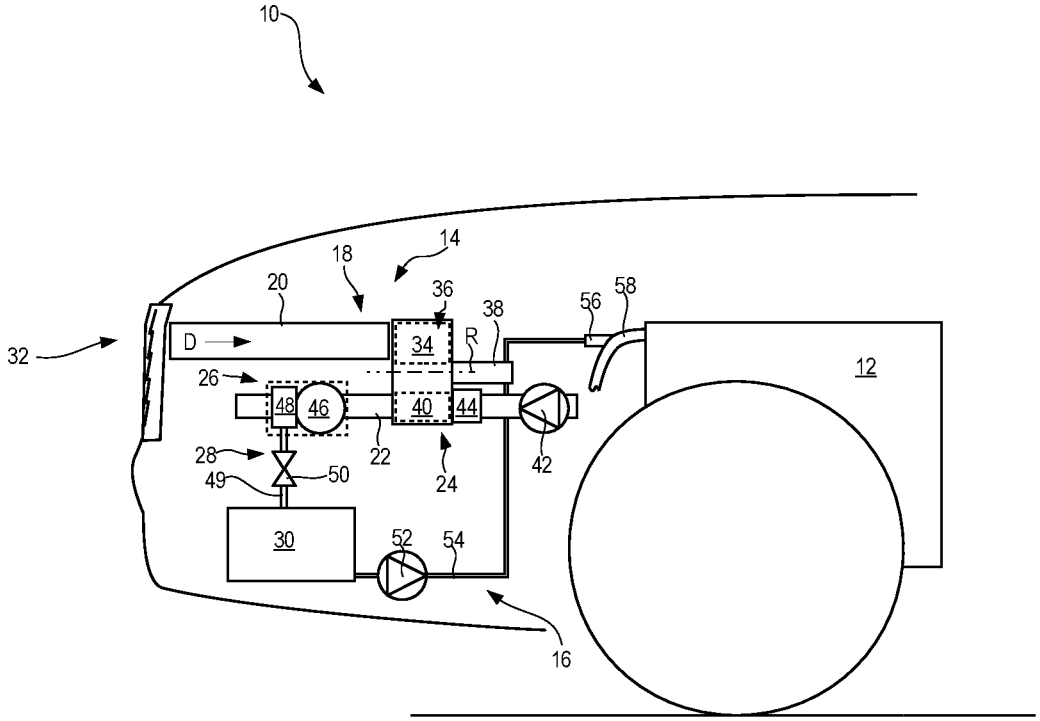
10
14
18
20
36
38
56
58
32
D
34
R
12
26
48
46
40
44
28
22
42
49
50
24
30
52
54
16

CONTINUOUSLY OPERATING WATER RECOVERY APPARATUS FOR A MOTOR VEHICLE

The present invention relates to a water recovery apparatus for a motor vehicle for recovering water from ambient air, encompassing:

a conveying conduit;

a condenser device that is embodied to modify the absolute value of at least one dew-relevant state variable of a working gas delivered through the conveying conduit to the condenser device;

a water discharge device that is embodied to discharge from the condenser device water condensed out of the working gas by the condenser device, the conveying conduit being embodied to convey ambient air as the working gas to the condenser device.

BACKGROUND OF THE INVENTION

A water recovery apparatus of this kind for a motor vehicle is known from DE 10 2016 206 043 A1. It serves to extract water contained in ambient air from the ambient air, and deliver it to a water injection device. The water injection device injects water into the fresh mixture of an internal combustion engine in order to decrease a knock tendency of the internal combustion engine and to reduce temperatures of a combustion exhaust gas released from the internal combustion engine. The injection of water into the fresh mixture occurs either directly into a combustion chamber of the internal combustion engine or into the intake manifold.

The known water recovery apparatus encompasses an absorption element, past which ambient air is passed and which in that context extracts water from the ambient air. The absorption element is regeneratable by heating, i.e. the absorption element releases the water extracted from the ambient air again when its element temperature is raised. For this purpose, hot combustion exhaust gas can be directed in an exhaust gas bypass duct past a heat exchange surface that is in turn in thermally transferring communication with the absorption element. The heat of the combustion exhaust gas can thus be used in order to heat and therefore regenerate the absorption element with no risk of contaminating the absorption element and the water absorbed by it, since the absorption element is physically separated from the combustion exhaust gas by the heat exchange surface.

The known water recovery apparatus is disadvantageous in that at any one time, flow can only ever occur through one duct from among the exhaust gas bypass duct and the conveying conduit portion passing by the absorption element. The water recovery apparatus has for that purpose corresponding shutoff valves, of which always only one allows flow while the other shuts it off. The known water recovery apparatus therefore operates in such a way that firstly water is absorbed at the absorption element, then the exhaust gas bypass duct is shut off, and after a sufficient absorption time the conveying conduit portion passing by the absorption element is shut off and flow occurs through the exhaust gas bypass duct. In this phase, the absorption element becomes regenerated and releases the previously absorbed water. The working gas, thereby enriched with water in the vicinity of the absorption element, is then delivered to a condenser device where the water dissolved in the working gas is separated from the working gas in known fashion by condensation, and is delivered in a liquid phase via the water discharge device to a water reservoir.

SUMMARY OF THE INVENTION

An object of the present invention is to eliminate the aforesaid disadvantages.

This object is achieved according to the present invention by a water recovery apparatus of the kind recited previously which is embodied to deliver working gas continuously to the condenser device. As a result of the continuous delivery of working gas to the condenser device, the latter is no longer supplied intermittently with working gas and can therefore be operated in a steady operating state in which operating parameters change very little or only within very narrow limits.

The term "working gas" refers to the gas processed by the condenser device. It can be ambient air itself directly or can be modified ambient air, for example ambient air having an elevated absolute humidity. The absolute humidity of the ambient air can be elevated by release of water to the ambient air. This is discussed in detail below as an advantageous refinement of the present invention. Ambient air is desirable as a basis for the working gas of the condenser device, since ambient air has the lowest degree of contamination of the gases easily available in a motor vehicle, and the water recoverable therefrom is therefore sufficiently clean without further purifying or filtering actions.

The water recovery apparatus can comprise a conveying pump that continuously or quasi-continuously conveys ambient air or working gas in the conveying conduit. Continuous conveying is possible, for example, by way of a rotating conveying pump, and quasi-continuous conveying by way of a piston pump having a reciprocating piston such that the frequency of the back-and-forth piston motion is at least 2 Hz. A conveying pump for conveying the working gas in the conveying conduit is not, however, obligatorily necessary. The conveying conduit can be arranged in a vehicle carrying the water recovery apparatus in such a way that ambient air flows onto it upon forward travel, so that the relative motion, induced by the vehicle's motion, of the conveying conduit in the ambient air can be used to convey ambient air through the conveying conduit.

In design terms, the condenser device can be embodied in various ways in order to modify a dew-relevant state variable of the working gas. A state variable is "dew-relevant" for purposes of the present invention if, by modification thereof, the relative humidity of air having a predefined constant absolute humidity can be modified. Because the solubility of water in a gas, in particular in air, is temperature-dependent, the condenser device can be embodied to decrease the temperature of the working gas. The condenser device can comprise for that purpose at least one Peltier element and/or one heat exchanger. The condenser device, in particular the at least one Peltier element and/or one heat exchange surface of the heat exchanger, preferably has a hygrophobic surface so that water condensing in the condenser device can be discharged from the condenser device via the water discharge device as completely as possible and with minimum outlay.

The solubility of water in air is substantially temperature-dependent. The absolute humidity of a gas, in particular in air, is directly dependent on the volume occupied by the gas and thus indirectly dependent on the gas pressure. For a predefined water content, the absolute humidity rises in inverse proportion to the volume occupied by the humid gas. Because the relative humidity is furthermore the ratio of the vapor pressure existing at a given temperature to the saturation vapor pressure applicable at that temperature, the condenser device can alternatively or additionally be embodied to modify the pressure of the working gas. For example, the condenser device can be embodied to depressurize the working gas as adiabatically as possible, with the result that water directly dissolved in the working gas can be precipitated from it. The condenser device can likewise be embodied to increase the pressure of the working gas so as thereby to bring the gas closer to the saturation point. This functions best as isothermal, or maximally isothermal, compression, since at a constant temperature the solubility of water in the gas, and thus the maximum possible quantity of water that can be received by a quantity of gas, does not change. Increasing the gas pressure, i.e. decreasing the gas volume, causes the relative humidity of the gas to rise, and the humid gas thus gets closer to its saturation point. Upon exceedance of the saturation point, water necessarily condenses in droplet form. Cooling of the working gas by the condenser device subsequent to the pressure increase allows a large quantity of water to be precipitated from the working gas that is then compressed.

The condenser device can thus comprise a compressor in order to compress, preferably to compress isothermally, the working gas as described above. In principle, that compressor can be a piston compressor having a reciprocating piston motion. In the interest of maximally uniform continuous operation of the condenser device, the compressor is preferably a continuously operating rotating compressor.

In order to increase the absolute humidity of the working gas delivered to the condenser device, according to a preferred refinement of the present invention a continuously operating water handling device, which extracts water from the conveyed ambient air and releases extracted water to the ambient air, can be arranged in the conveying conduit. The conveying conduit can comprise for that purpose a plurality of conveying paths in which ambient air can flow in the same flow direction or in different flow directions, in particular in counter-current fashion.

The water handling device can comprise a water reception zone in which the water handling device extracts water from an ambient air flow, and can comprise a water release zone in which the water handling device releases previously extracted water to an ambient air flow. The ambient air flows are preferably different. The ambient air flow delivered to the water reception zone flows away from the water reception zone with a lower absolute humidity than when it flowed to it, since it discharges moisture to the water reception zone. The ambient air flow that is delivered to the water reception zone is therefore preferably an unmanipulated ambient air flow that has a higher absolute atmospheric humidity than the ambient air flow flowing away from the water reception zone.

For targeted release of previously received water, the water handling device preferably comprises a regeneratable water reception medium. In order for it to be possible, with the water reception medium, firstly to receive water in the water reception zone and then to release water in the water release zone, the water reception medium is preferably displaceable between the water reception zone and the water release zone.

In principle, the water reception medium can be displaceable in any manner between the water reception zone and the water release zone. In the interest of maximally continuous operation of the water handling device, the water reception medium is preferably displaceable rotationally between the aforesaid zones. The water reception zone and water release zone are preferably provided in positionally unmodifiable fashion. A media body comprising the water reception medium, constituting a water adsorption medium and/or a water absorption medium, is preferably continuously rotationally displaceable between the water reception zone and the water release zone.

For controlled regeneration of the water reception medium, the water handling device preferably comprises a heating device. The heating device makes it possible, for example, to raise the water release zone to a higher temperature level than the water reception zone. By heating the water reception medium in the water release zone, the water reception medium can thereby be locally regenerated, and thus dried, therein. The heating device can directly heat the ambient air flow delivered to the water release zone, and thereby indirectly heat the water release zone; this furthermore has the advantage that the ambient air flow thereby heated can discharge from the water release zone, upon passage past the water release zone, more water per quantitative unit of ambient air than an ambient air flow at lower temperature. It is not to be excluded, however, that the heating device directly heats the water reception medium in the region of the water release zone, for example by irradiation and the like.

Preferably the water reception medium, particularly preferably the media body, is capable of having ambient air or working gas flow through it at least in the region of the water reception zone and the water release zone, preferably in opposite directions in the interest of advantageous space utilization, so that the largest possible surface area of the water reception medium can be wetted by inflowing ambient air in the shortest possible time. A comparatively large quantity of water can thus be received in the water reception zone from the ambient air flowing through the water reception medium, and likewise released in the water release zone to the ambient air flowing through the water reception medium, in a short time.

In order to recover the water released in the water release zone to the ambient air flowing by, it is preferred if the conveying conduit connects the water release zone to the condenser device.

In order to avoid losses of the liquid water recovered in the condenser device, the water discharge device can comprise a valve with which a water line of the water discharge device can be opened for the passage of water or closed to prevent the passage of water. This applies both to liquid water and to water in vapor form. The water discharge device is preferably disconnectable, for example so that parts of the water discharge device can be removed from a vehicle carrying the water recovery apparatus. It is likewise preferably conceivable for the water discharge device to connect the condenser device to a water tank in which the liquid water recovered by the condenser device is collected and stored until it is delivered for the purpose recited previously, for example by a water injection device, to a fresh mixture of an internal combustion engine of the vehicle carrying the water recovery apparatus. In order to allow a water tank of this kind to be removed from the water recovery apparatus with minimal loss of recovered water, the water discharge device is particularly preferably disconnectable upstream from the valve in a flow direction away from the condenser device. The valve can thus block off that remaining portion of the water discharge device which leads to the water tank, and the water tank can thus be removed from the vehicle, if necessary, along with that remaining portion and the valve.

The present invention likewise relates to a motor vehicle having an internal combustion engine, having a water recovery apparatus as described and refined above, and having a water injection device for injecting water into a fresh mixture delivered to the internal combustion engine. The term "fresh mixture" refers in the present Application to an ignitable fuel/air mixture.

The water injection device of the motor vehicle is coupled to the water recovery apparatus in such a way that it injects the water recovered by the water recovery apparatus into the fresh mixture. The refilling cycle of a water reservoir of the water injection device can thus be lengthened by the water recovery apparatus.

The aforementioned water tank that connects the water discharge device to the condenser device is preferably a shared water tank or water reservoir of both the water recovery apparatus and the water injection device. The water injection device can thus draw water out of the same water tank into which the water discharge device delivers.

These and other objects, aspects, features and advantages of the invention will become apparent to those skilled in the art upon a reading of the Detailed Description of the invention set forth below taken together with the drawing which will be described in the next section.

BRIEF DESCRIPTION OF THE DRAWING

The invention may take physical form in certain parts and arrangement of parts, a preferred embodiment of which will be described in detail and illustrated in the accompanying drawing which form a part hereof and wherein:

FIG. 1 is a schematic depiction of a water recovery apparatus in accordance with the present invention, incorporated into a motor vehicle.

DESCRIPTION OF PREFERRED EMBODIMENTS

Referring now to the drawing wherein the showings are for the purpose of illustrating preferred and alternative embodiments of the invention only and not for the purpose of limiting the same, FIG. 1 is a schematic depiction of a passenger car, labeled with the reference character 10. Said car comprises an internal combustion engine 12 that is operated using fossil fuel and supplies the propulsive energy of motor vehicle 10.

Motor vehicle 10 comprises a water recovery apparatus 14, explained in detail below, which serves to recover water for a water injection device 16 from ambient air.

Water recovery apparatus 14 comprises a conveying conduit 18 having two conveying paths 20 and 22 separated from one another. Apparatus 14 further comprises a water handling device 24 and a condenser device 26. A water discharge device 28 leads from condenser device 26 to a water tank 30.

In the example depicted, the inlet of conveying path 20 of conveying conduit 18 is located behind an air flap apparatus 32 that can be opened or closed during operation of vehicle 10 for ambient air to flow through. Air flap apparatus 32 does not need to be present. Conveying path 20 can be provided in such a way that a flow of air blast onto it always occurs as vehicle 10 is traveling forward, or it can be equipped with a fan that conveys ambient air in the desired flowthrough direction D.

Ambient air therefore flows through conveying path 20 in flowthrough direction D and reaches water handling device 24. More precisely, it reaches a water reception zone 34, provided in stationary fashion on water handling device 24, through which ambient air can flow in flowthrough direction D. Located in water handling device 24 is a media body 36 encompassing a water-adsorbing material, for example a silica gel or silicic-acid gel. Media body 36 is constructed, for example, in honeycomb fashion, and air can flow through it in and oppositely to flowthrough direction D.

While ambient air is flowing through, the silicic-acid gel, which is hygroscopic as an inherent property of its material, extracts water from the ambient air and stores it in its material structure.

Media body 36 is rotatable around rotation axis R by a drive motor 38. As a result, a region of media body 36 that is firstly located in water reception zone 34 is displaceable into a water release zone 40 that is different from water reception zone 34 and is likewise provided in stationary fashion on water handling device 24. The displacement of regions of media body 36 between water reception zone 34 and water release zone 40 occurs continuously in time and in space.

Second conveying path 22 of conveying conduit 18 comprises a fan 42 that conveys ambient air along second conveying path 22 oppositely to flowthrough direction D of first conveying path 20. From its inlet located to the right in FIG. 1, the ambient air conveyed by fan 42 firstly reaches a heating device 44 of water handling device 24, where the ambient air flowing through it becomes heated.

The ambient air that is thereby heated heats media body 36 in the region of water release zone 40, with the result that media body 36 releases the water, previously received in water reception zone 34, to the ambient air flow that is flowing through it. Upstream from water handling device 24, the ambient air flowing in the respective conveying paths 20 and 22 possesses its respective meteorologically existing absolute humidity. The ambient air flowing in conveying path 20 has a lower absolute humidity downstream from water handling device 24 than upstream from device 24, due to the release of water in water reception zone 34. The ambient air flowing in conveying path 22 has a higher absolute humidity downstream from water handling device 24 than upstream from device 24, due to the reception of water in water release zone 40.

Flow thus occurs through water reception zone 34 and water release zone 40 of water handling device 24 parallel to rotation axis R but in opposite directions. This is merely an example, however.

The modified ambient air that emerges with elevated absolute humidity from water release zone 40 is conveyed as a working gas to condenser device 26 by conveying path 22. In the example depicted, condenser device 26 encompasses a pressure modification device 46 and a cooling device 48. Pressure modification device 46 can be a rotating, continuously operating compressor or a pressure reducer. Cooling device 48 encompasses, for example, a Peltier element and/or a heat exchanger for releasing heat to a cooling medium flowing through the heat exchanger.

Pressure modification device 46 modifies the pressure of the working gas and brings it closer to its saturation limit, i.e. to a point at which the working gas has a relative humidity of between 95% and 100%. This occurs preferably as isothermal compression. The pressure modification apparatus can have a cooling apparatus for this purpose in order to compensate for the temperature elevation produced by the compression of the working gas.

Directly adjacently to pressure modification device 46, the working gas is cooled by cooling device 48. The result is that water precipitates in droplet form out of the working gas, condenses on the preferably hygrophobically coated walls of condenser device 26, in particular a Peltier element, and flows off from there in response to gravity and is conveyed by water discharge device 28 to water tank 30. The water precipitated in condenser device 26 is collected in water tank 30.

A water line 49 of water discharge device 28 can be shut off by means of a valve 50. Water line 49 of water discharge device 28 is preferably disconnectable in the region of valve 50, so that water tank 30 can be removed from vehicle 10. Water discharge device 28 can be disconnectable on one or both sides of valve 50. Preferably valve 50 remains on that part of water discharge device 28 which is continuous with water tank 30, so that water tank 30 can be removed in sealed fashion from vehicle 10.

Water tank 30 is not only a collection container of water recovery apparatus 14, but also a water reservoir of water injection device 16.

Water injection device 16 can comprise a conveying pump 52 with which water can be conveyed in a conveying line 54 from water tank 30 to an injection valve 56, where it is injected into an intake manifold 58 in which ignitable fresh mixture is delivered to internal combustion engine 12.

The refilling cycles of water tank 30 are lengthened as a result of water recovery apparatus 14. As a result of the continuous operation of water recovery apparatus 14 which is possible with the present invention, said apparatus can be operated using optimum steady-state operating parameters.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A water recovery apparatus for a motor vehicle for recovering water from ambient air, encompassing:

a conveying conduit;

a condenser device that is embodied to modify the absolute value of at least one dew-relevant state variable of a working gas delivered through the conveying conduit to the condenser device;

a water discharge device that is embodied to discharge from the condenser device water condensed out of the working gas by the condenser device, the conveying conduit being embodied to convey ambient air as the working gas to the condenser device, wherein the water recovery apparatus is embodied to deliver working gas continuously to the condenser device, wherein a continuously operating water handling device, which extracts water from a first flow of ambient air and releases extracted water to a second flow of ambient air to form the working gas, is arranged in the conveying conduit, wherein the continuously operating water handling device comprises a water reception zone in which the water handling device extracts water from the first flow of ambient air, the continuously operating water handling device further comprises a water release zone in which the continuously operating water handling device releases extracted water to the second flow of ambient air, the continuously operating water handling device comprising a regeneratable water reception medium that is displaceable between the water reception zone and the water release zone.

2. The water recovery apparatus according to claim 1, wherein the condenser device is embodied to decrease the temperature of the working gas.

3. The water recovery apparatus according to claim 2, wherein the condenser device comprises at least one of a Peltier element and a heat exchanger.

4. The water recovery apparatus according to claim 1, wherein the condenser device is embodied to modify the pressure of the working gas.

5. The water recovery apparatus according to claim 4, wherein the condenser device is embodied to raise isothermally the pressure of the working gas.

6. The water recovery apparatus according to claim 4, wherein the condenser device comprises a compressor.

7. The water recovery apparatus according to claim 6, wherein the compressor is a continuously operating rotating compressor.

8. The water recovery apparatus according to claim 1, wherein a media body comprising the water reception medium is continuously rotationally displaceable between the water reception zone and the water release zone, the water reception medium including at least one of a water adsorption medium and a water absorption medium.

9. The water recovery apparatus according to claim 1, wherein the continuously operating water handling device comprises a heating device, in particular in order to raise the water release zone to a higher temperature level than the water reception zone.

10. The water recovery apparatus according to claim 1, wherein the conveying conduit connects the water release zone to the condenser device.

11. The water recovery apparatus according to claim 1, wherein the water discharge device comprises a valve with which a water line of the water discharge device is openable for the passage of water or closable to prevent the passage of water.

12. The water recovery apparatus according to claim 11, wherein the water discharge device is at least one of disconnectable and disconnectable upstream from the valve in a flow direction away from the condenser device.

13. The water recovery apparatus according to claim 1, further comprising a water tank, the water discharge device connecting the condenser device to the water tank.

14. A motor vehicle having an internal combustion engine, having a water recovery apparatus according to claim 1, and having a water injection device for injecting water into a fresh mixture delivered to the internal combustion engine, wherein the water injection device is coupled to the water recovery apparatus in such a way that it injects the water recovered by the water recovery apparatus into the fresh mixture.

15. The motor vehicle according to claim 14, further comprising a water tank, the water discharge device connecting the condenser device to the water tank, wherein the water tank is a shared water tank of the water recovery apparatus and of the water injection device.

* * * * *